US009905922B2

(12) United States Patent
Lee et al.

(10) Patent No.: US 9,905,922 B2
(45) Date of Patent: Feb. 27, 2018

(54) WIRELESS DEVICE WITH 3-D ANTENNA SYSTEM

(75) Inventors: Cheol-Woong Lee, San Jose, CA (US); Mohammad A. Tassoudji, Cardiff, CA (US); Roger Brockenbrough, Los Gatos, CA (US)

(73) Assignee: QUALCOMM Incorporated, San Diego, CA (US)

( * ) Notice: Subject to any disclaimer, the term of this patent is extended or adjusted under 35 U.S.C. 154(b) by 440 days.

(21) Appl. No.: 13/223,127

(22) Filed: Aug. 31, 2011

(65) Prior Publication Data

US 2013/0050056 A1 Feb. 28, 2013

(51) Int. Cl.

| | |
|---|---|
| ***H01Q 3/30*** | (2006.01) |
| ***H01Q 1/22*** | (2006.01) |
| ***H01Q 1/24*** | (2006.01) |
| ***H01Q 3/24*** | (2006.01) |
| ***H01Q 9/04*** | (2006.01) |

(52) U.S. Cl.

CPC ..... *H01Q 3/30* (2013.01); *H01Q 1/2291* (2013.01); *H01Q 1/243* (2013.01); *H01Q 3/24* (2013.01); *H01Q 9/0407* (2013.01)

(58) Field of Classification Search

CPC ..... H01Q 21/00

USPC ..... 343/893

See application file for complete search history.

(56) References Cited

U.S. PATENT DOCUMENTS

| | | | | |
|---|---|---|---|---|
| 6,426,726 | B1 * | 7/2002 | Yablon | H01Q 15/24 343/754 |
| 7,768,457 | B2 * | 8/2010 | Pettus et al. | 343/700 MS |
| 8,487,816 | B2 * | 7/2013 | Saily | 343/700 MS |
| 2006/0038738 | A1 * | 2/2006 | Shtrom | H01Q 3/24 343/876 |

(Continued)

FOREIGN PATENT DOCUMENTS

| | | | |
|---|---|---|---|
| CN | 1685563 | A | 10/2005 |
| CN | 101471711 | A | 7/2009 |

(Continued)

OTHER PUBLICATIONS

Bzeih, A., et al., "Empirical Formulation and Design of a Broadband Enhanced E-Patch Antenna", National Radio Science Conference, 2007, NRSC 2007, IEEE, PI, Mar. 1, 2007 (Mar. 1, 2007), pp. 1-9, XP031177341.

(Continued)

*Primary Examiner* — Andrea Lindgren Baltzell

(74) *Attorney, Agent, or Firm* — Patterson & Sheridan, L.L.P.

(57) ABSTRACT

Techniques for improving coverage of an antenna system are disclosed. In an aspect, a wireless device includes a 3-D antenna system to improve coverage and enhance performance. The 3-D antenna system includes antenna elements formed on multiple planes pointing in different spatial directions. Antenna elements formed on the multiple planes are associated with different antenna beams, which can provide a larger line-of-sight (LOS) coverage for the wireless device. Beamforming may be performed for the anten- (Continued)

nas on a given plane to further improve LOS coverage. Non-LOS (NLOS) coverage may also improve since antenna beams pointing in different spatial directions may result in reflected signals of higher power levels due to better signal reflection for some antenna beams.

20 Claims, 11 Drawing Sheets

(56) References Cited

U.S. PATENT DOCUMENTS

| | | | | |
|---|---|---|---|---|
| 2006/0038739 | A1 | 2/2006 | Feng et al. | |
| 2006/0276157 | A1 | 12/2006 | Chen et al. | |
| 2007/0097009 | A1* | 5/2007 | Torres | H01Q 1/1271 343/795 |
| 2008/0079636 | A1 | 4/2008 | Mohamadi | |
| 2008/0291098 | A1* | 11/2008 | Kish | H01Q 3/242 343/725 |
| 2009/0143038 | A1 | 6/2009 | Saito | |
| 2010/0075687 | A1* | 3/2010 | Chayat | H04W 72/046 455/450 |
| 2010/0225539 | A1* | 9/2010 | Margomenos | G01S 7/032 342/373 |
| 2011/0018784 | A1* | 1/2011 | Hilsebecher et al. | 343/893 |

FOREIGN PATENT DOCUMENTS

| | | | | |
|---|---|---|---|---|
| CN | 101496298 | A | 7/2009 | |
| DE | WO2009/080387 | A1 * | 7/2009 | H01Q 1/32 |
| EP | 2068394 | A1 | 6/2009 | |
| JP | 2001298388 | A | 10/2001 | |
| JP | 2005045598 | A | 2/2005 | |
| JP | 2009141961 | A | 6/2009 | |
| SE | PCT/SE95/00623 | * | 5/1995 | H01Q 1/38 |
| SE | WO 95/34102 | * | 12/1995 | H01Q 1/38 |
| WO | WO-2004027921 | A2 | 4/2004 | |
| WO | 2012125774 | A2 | 9/2012 | |

OTHER PUBLICATIONS

IEEE Standard for Information technology—Telecommunications and information exchange between systems—Local and metropolitan area networks—Specific requirements. Part 15.3: Wireless Medium Access Control (MAC) and Physical Layer (PHY) Specifications for High Rate Wireless Personal Area Networks, IEEE Standard, IEEE, Piscataway, NJ, USA, Oct. 12, 2009 (Oct. 12, 2009), pp. C1-C187, XP017604237, ISBN: 978-0-7381-6050-4.

International Search Report and Written Opinion—PCT/US2012/053545—ISA/EPO—dated Oct. 30, 2012.

Bhatnagar M., et al., "For High-Speed Wireless Networks Broadband and High-Gain E-Shaped Microstrip Antennas", Emerging Trends in Electronic and Photonic Devices & Systems, 2009, Electro '09. International Conference on 2009, pp. 300-302.

* cited by examiner

WIRELESS DEVICE WITH 3-D ANTENNA SYSTEM

BACKGROUND

I. Field

The present disclosure relates generally to electronics, and more specifically to a wireless device.

II. Background

A wireless device (e.g., a cellular phone or a smart phone) may include a transmitter and a receiver coupled to an antenna to support two-way communication. For data transmission, the transmitter may modulate a radio frequency (RF) carrier signal with data to obtain a modulated signal, amplify the modulated signal to obtain an output RF signal having the proper power level, and transmit the output RF signal via the antenna to a base station. For data reception, the receiver may obtain a received RF signal via the antenna and may condition and process the received RF signal to recover data sent by the base station.

A wireless device may include multiple transmitters and/or multiple receivers coupled to multiple antennas in order to improve performance. It may be challenging to design and build multiple antennas on the wireless device, especially at a very high frequency.

DETAILED DESCRIPTION

The detailed description set forth below is intended as a description of exemplary designs of the present disclosure and is not intended to represent the only designs in which the present disclosure can be practiced. The term "exemplary" is used herein to mean "serving as an example, instance, or illustration." Any design described herein as "exemplary" is not necessarily to be construed as preferred or advantageous over other designs. The detailed description includes specific details for the purpose of providing a thorough understanding of the exemplary designs of the present disclosure.

It will be apparent to those skilled in the art that the exemplary designs described herein may be practiced without these specific details. In some instances, well-known structures and devices are shown in block diagram form in order to avoid obscuring the novelty of the exemplary designs presented herein.

A wireless device with a 3-D antenna system is described herein. A 3-D antenna system is an antenna system that includes antenna elements formed on multiple planes pointing in different spatial directions, e.g., on two or more surfaces of a wireless device. A plane may "point" in a spatial direction that is orthogonal to the plane. The phrases "point in" and "point at" are used interchangeably herein. A wireless device with a 3-D antenna system may be any electronics device supporting wireless communication.

Figure 1:
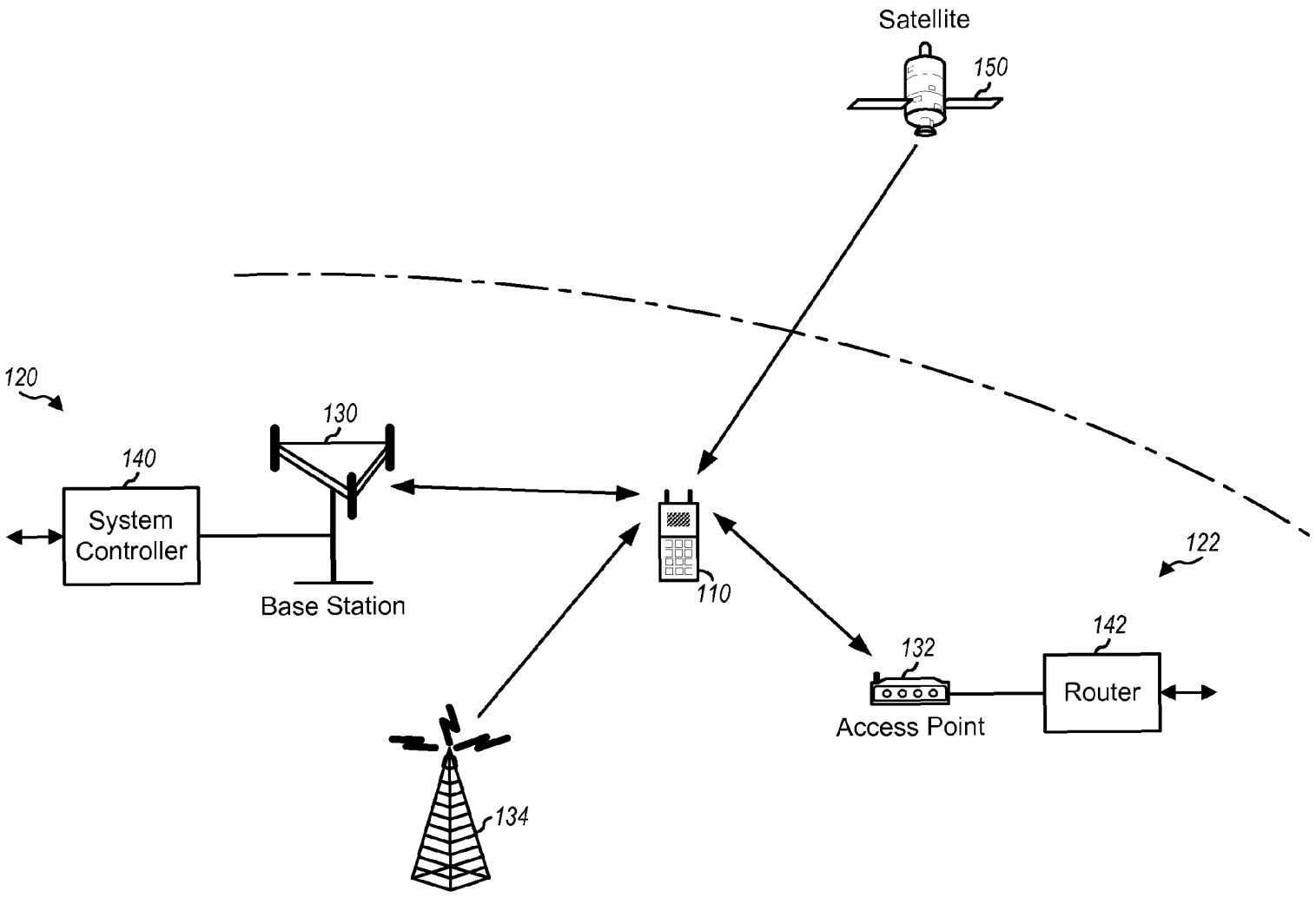
FIG. 1 shows a wireless device capable of communicating with different wireless communication systems.

FIG. 1 shows a wireless device 110 capable of communicating with different wireless communication systems 120 and 122. Wireless system 120 may be a Code Division Multiple Access (CDMA) system (which may implement Wideband CDMA (WCDMA), cdma2000, or some other version of CDMA), a Global System for Mobile Communications (GSM) system, a Long Term Evolution (LTE) system, etc. Wireless system 122 may be a wireless local area network (WLAN) system, which may implement IEEE 802.11, etc. For simplicity, FIG. 1 shows wireless system 120 including one base station 130 and one system controller 140, and wireless system 122 including one access point 132 and one router 142. In general, each system may include any number of stations and any set of network entities.

Wireless device 110 may also be referred to as a user equipment (UE), a mobile station, a terminal, an access terminal, a subscriber unit, a station, etc. Wireless device 110 may be a cellular phone, a smart phone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may be equipped with any number of antennas. Multiple antennas may be used to provide better performance, to simultaneously support multiple services (e.g., voice and data), to provide diversity against deleterious path effects (e.g., fading, multipath, and interference), to support multiple-input multiple-output (MIMO) transmission to increase data rate, and/or to obtain other benefits. Wireless device 110 may be capable of communicating with wireless system 120 and/or 122. Wireless device 110 may also be capable of receiving signals from broadcast stations (e.g., a broadcast station 134). Wireless device 110 may also be capable of receiving signals from satellites (e.g., a satellite 150) in one or more global navigation satellite systems (GNSS).

In general, wireless device 110 may support communication with any number of wireless systems, which may employ any radio technologies such as WCDMA, cdma2000, LTE, GSM, 802.11, GPS, etc. Wireless device 110 may also support operation on any number of frequency bands.

Wireless device 110 may support operation at a very high frequency, e.g., within millimeter (mm)-wave frequencies from 40 to 300 gigahertz (GHz). For example, wireless device 110 may operate at 60 GHz for 802.11 ad. Wireless device 110 may include an antenna system to support operation at mm-wave frequency. The antenna system may include a number of antenna elements, with each antenna element being used to transmit and/or receive signals. The terms "antenna" and "antenna element" are synonymous and are used interchangeably herein. Each antenna element may be implemented with a patch antenna, a dipole antenna, or an antenna of some other type. A suitable antenna type may be selected for use based on the operating frequency of the wireless device, the desired performance, etc. In an exemplary design, an antenna system may include a number of patch antennas supporting operation at mm-wave frequency.

Figure 2:
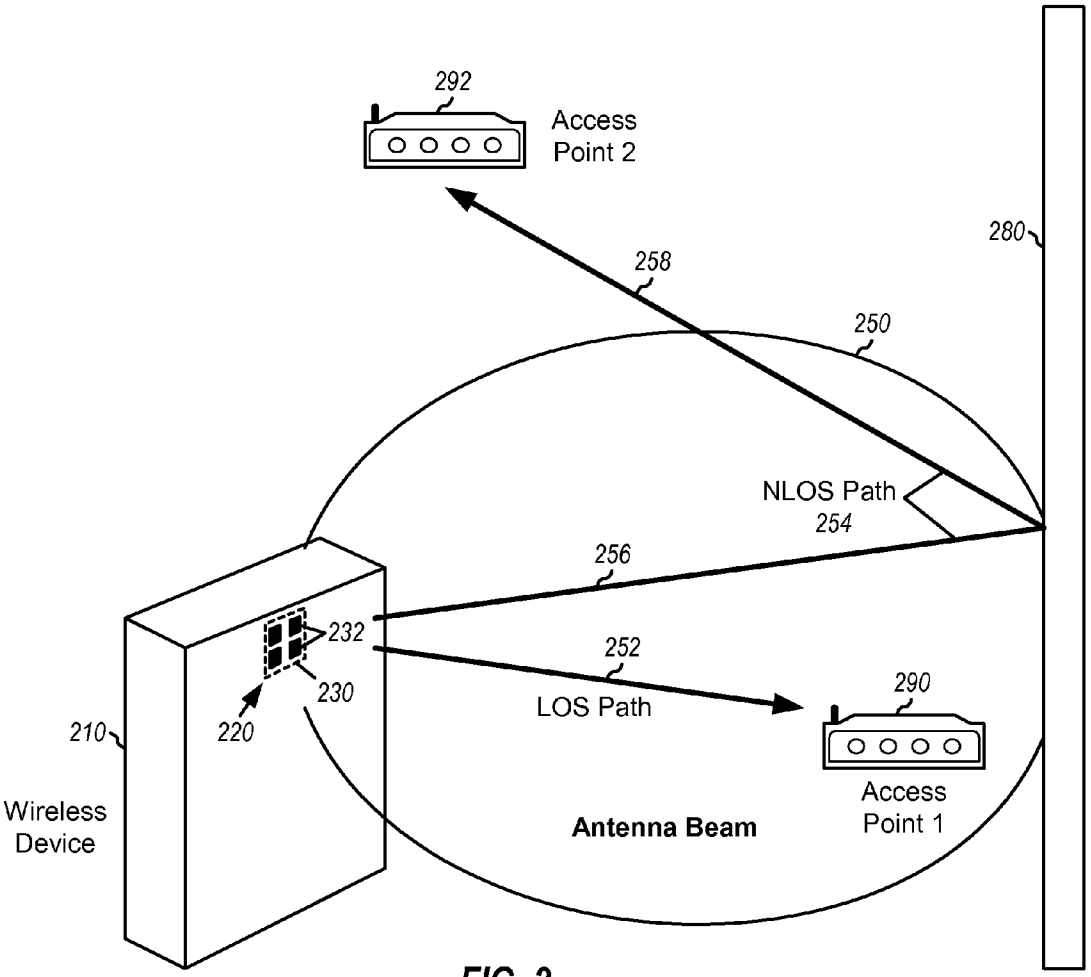
FIG. 2 shows a wireless device with a 2-dimensional (2-D) antenna system.

FIG. 2 shows an exemplary design of a wireless device 210 with a 2-D antenna system 220. In this exemplary design, antenna system 220 includes a 2×2 array 230 of four patch antennas 232 formed on a single plane corresponding to the front surface of wireless device 210. Patch antenna array 230 has an antenna beam 250, which points in a direction that is orthogonal to the plane on which patch antennas 232 are formed. Wireless device 210 can transmit signals directly to other devices (e.g., access points) located within antenna beam 250 and can also receive signals directly from other devices located within antenna beam 250. Antenna beam 250 thus represents a line-of-sight (LOS) coverage of wireless device 210.

An access point 290 (i.e., another device) may be located inside the LOS coverage of wireless device 210. Wireless device 210 can transmit a signal to access point 290 via a line-of-sight (LOS) path 252. Another access point 292 may be located outside the LOS coverage of wireless device 210. Wireless device 210 can transmit a signal to access point 292 via a non-line-of-sight (NLOS) path 254, which includes a direct path 256 from wireless device 210 to a wall 280 and a reflected path 258 from wall 280 to access point 292.

In general, wireless device 210 can transmit a signal via a LOS path directly to another device located within antenna beam 250, e.g., as shown in FIG. 2. This signal may have a much lower power loss when received via the LOS path. The low power loss may allow wireless device 210 to transmit the signal at a lower power level, which may enable wireless device 210 to conserve battery power and extend battery life.

Wireless device 210 can transmit a signal via a NLOS path to another device located outside of antenna beam 250, e.g., as also shown in FIG. 2. This signal may have a much higher power loss when received via the NLOS path, since a large portion of the signal energy may be reflected, absorbed, and/or scattered by one or more objects in the NLOS path. Wireless device 210 can transmit the signal at a high power level in order to ensure that the signal can be reliably received via the NLOS path. However, wireless device 210 may consume excessive battery power in order to transmit the signal at the high power level.

An antenna element may be formed on a plane corresponding to a surface of a wireless device and may be used to transmit and/or receive signals. The antenna element may have a particular antenna beam pattern and a particular maximum antenna gain, which may be dependent on the design and implementation of the antenna element. Multiple antenna elements may be formed on the same plane and used to improve antenna gain. Higher antenna gain may be especially desirable at mm-wave frequency since (i) it is difficult to efficiently generate high power at mm-wave frequency and (ii) attenuation loss may be greater at mm-wave frequency. Each antenna element may have a limited LOS coverage area due to the directivity of the antenna element. An antenna system composed of multiple antenna elements would also have a limited LOS coverage area. The area outside of the LOS coverage area may be covered by reflected signals, but the signal strength may be weak in the NLOS coverage area. Hence, it is preferable to have a larger LOS coverage area if possible.

In an aspect, a wireless device may include a 3-D antenna system to improve LOS coverage and enhance performance. The 3-D antenna system may include antenna elements formed on multiple planes pointing in different spatial directions. The 3-D antenna system would then have multiple antenna beams corresponding to the multiple planes on which the antenna elements are formed. The antenna beam for each plane would cover a different LOS coverage area. The multiple antenna beams can provide a larger overall LOS coverage area for the wireless device. NLOS coverage may also improve since antenna beams pointing in different spatial directions may result in reflected signals of higher power levels due to better signal reflection for some antenna beams.

Figure 3:
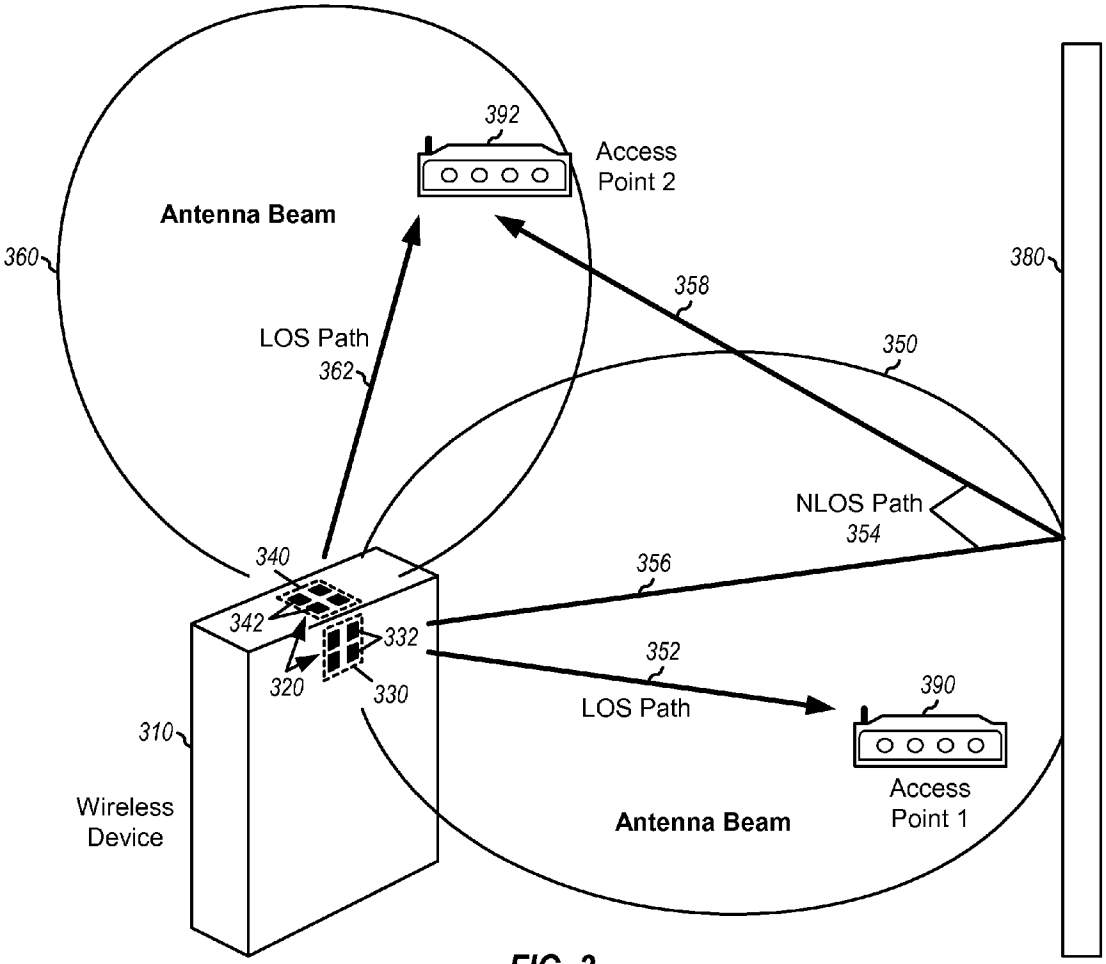
FIG. 3 shows a wireless device with a 3-dimensional (3-D) antenna system.

FIG. 3 shows an exemplary design of a wireless device 310 with a 3-D antenna system 320. In this exemplary design, antenna system 320 includes (i) a 2×2 array 330 of four patch antennas 332 formed on a first plane corresponding to the front surface of wireless device 310 and (ii) a 2×2 array 340 of four patch antennas 342 formed on a second plane corresponding to the top surface of wireless device 310. Antenna array 330 has an antenna beam 350, which points in a direction that is orthogonal to the first plane on which patch antennas 332 are formed. Antenna array 340 has an antenna beam 360, which points in a direction that is orthogonal to the second plane on which patch antennas 342 are formed. Antenna beams 350 and 360 thus represent the LOS coverage of wireless device 310.

An access point 390 (i.e., another device) may be located inside the LOS coverage of antenna beam 350 but outside the LOS coverage of antenna beam 360. Wireless device 310 can transmit a first signal to access point 390 via a LOS path 352 within antenna beam 350. Another access point 392 may be located inside the LOS coverage of antenna beam 360 but outside the LOS coverage of antenna beam 350. Wireless device 310 can transmit a second signal to access point 392 via a LOS path 362 within antenna beam 360. Wireless device 310 can transmit a signal to access point 392 via a NLOS path 354 composed of a direct path 356 and a reflected path 358 due to a wall 380. Access point 392 may receive the signal via LOS path 362 at a higher power level than the signal via NLOS path 354.

As shown in FIGS. 2 and 3, the LOS coverage of wireless device 310 may be enhanced by using a 3-D antenna system having antenna elements formed on multiple planes. This may allow wireless device 310 to transmit signals to multiple other devices simultaneously. This may also allow wireless device 310 to transmit a signal at a lower power level in more scenarios, which may enable wireless device 310 to conserve battery power and extend battery life.

The NLOS coverage of wireless device 310 may also be improved by using 3-D antenna system 320. The signals transmitted via different antenna beams may encounter different objects and may be reflected and/or scattered in different directions. This may allow signals from wireless device 310 to be received at more locations and/or at higher power levels, which may improve the coverage of wireless device 310.

FIG. 3 shows an exemplary design of a 3-D antenna system comprising two 2×2 antenna arrays 330 and 340 formed on two planes. In general, a 3-D antenna system may include any number of antenna elements formed on any number of planes pointing in different spatial directions. The planes may or may not be orthogonal to one another. Any number of antennas may be formed on each plane and may be arranged in any formation. Using antennas on more planes may improve LOS coverage and possibly NLOS coverage.

Figure 4B:
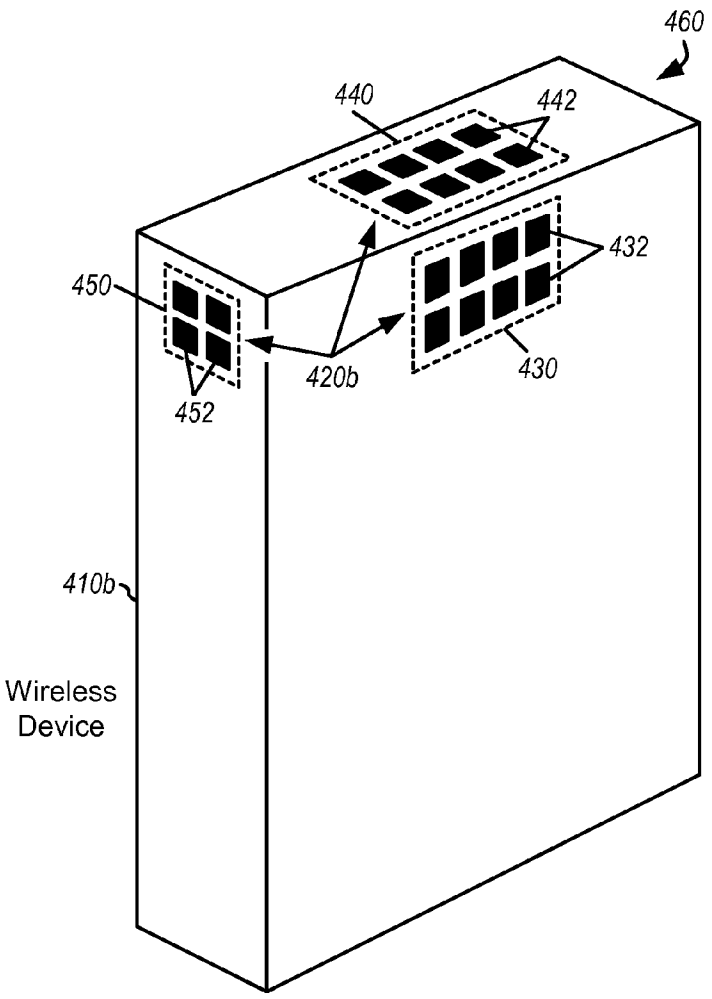
FIGS. 4A and 4B show two exemplary designs of a 3-D antenna system.
Figure 4A:
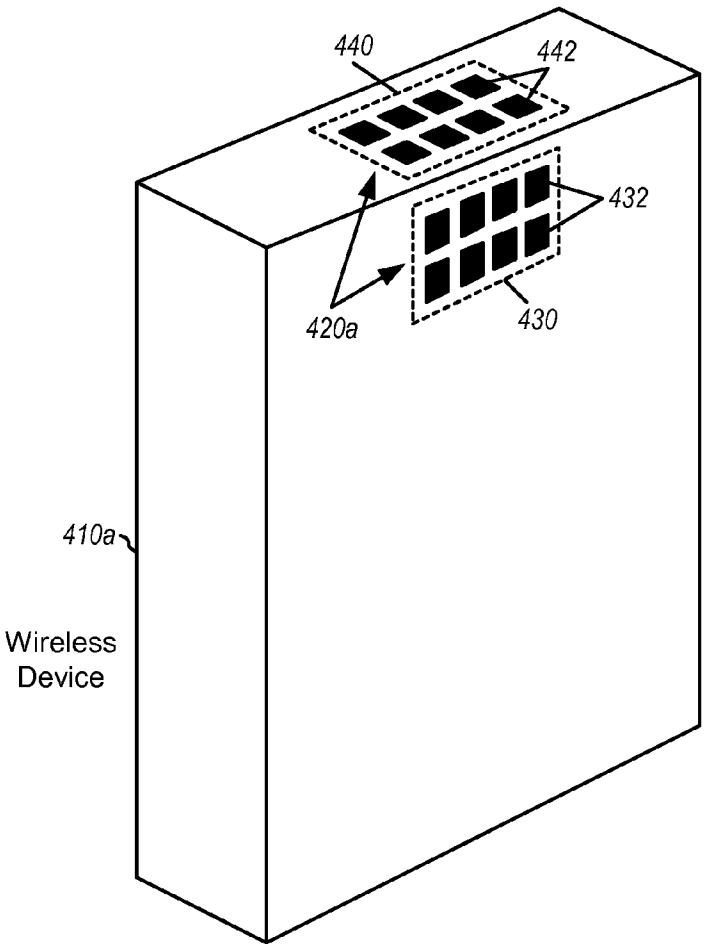

FIG. 4A shows an exemplary design of a wireless device 410*a* with a 3-D antenna system 420*a*. In this exemplary design, antenna system 420*a* includes (i) a 4×2 array 430 of eight patch antennas 432 formed on a first plane corresponding to the front surface of wireless device 410*a* and (ii) a 4×2 array 440 of eight patch antennas 442 formed on a second plane corresponding to the top surface of wireless device 410*a*. Antenna array 430 has a first antenna beam that points in a direction that is orthogonal to the first plane on which patch antennas 432 are formed. Antenna array 440 has a second antenna beam that points in a direction that is orthogonal to the second plane on which patch antennas 442 are formed.

FIG. 4B shows an exemplary design of a wireless device 410*b* with a 3-D antenna system 420*b*. In this exemplary design, antenna system 420*b* includes 4×2 array 430 of eight patch antennas 432 and 4×2 array 440 of eight patch antennas 442, similar to 3-D antenna system 420*a* in FIG. 4A. 3-D antenna system 420*b* further includes (i) a 4×2 array 450 of four patch antennas 452 formed on a third plane corresponding to the left side surface of wireless device 410*b* and (ii) a 2×2 array 460 of four patch antennas (not visible in FIG. 4B) formed on a fourth plane corresponding to the right side surface of wireless device 410*b*. Antenna arrays 430, 440, 450 and 460 have four antenna beams that point in different spatial directions.

FIGS. 4A and 4B show two exemplary designs of a 3-D antenna system. A 3-D antenna system may also be implemented in other manners. For example, a 3-D antenna system may include antenna arrays on the front and two sides (but not the top), or antenna arrays on the front and back (but not the top or sides), or antenna arrays on the front, back, and two sides (but not the top), or antenna arrays on the front, back, top, and two sides. A 3-D antenna system may also include antennas of other types (instead of patch antennas) and/or antennas arranged in other formations (instead of 2-D arrays).

In general, a 3-D antenna system may include antennas of any type or any combination of types. For example, a 3-D antenna system may include patch antennas, monopole antennas, dipole antennas, loop antennas, microstrip antennas, stripline antennas, printed dipole antennas, inverted F antennas, planar inverted F antennas (PIFA), polarized patches, plate antennas (which are irregularly shaped, flat antennas with no ground plane), half-wave antennas, quarter-wave antennas, etc. A patch antenna is also referred to as a planar antenna. A dipole antenna is also referred to as a whip antenna. A suitable type of antennas to use for a 3-D antenna system may be selected based on various factors such as the operating frequency of a wireless device, the desired performance, etc. Several exemplary designs of patch antennas suitable for use at 60 GHz (e.g., for 802.11ad) are described below.

Figure 5A:
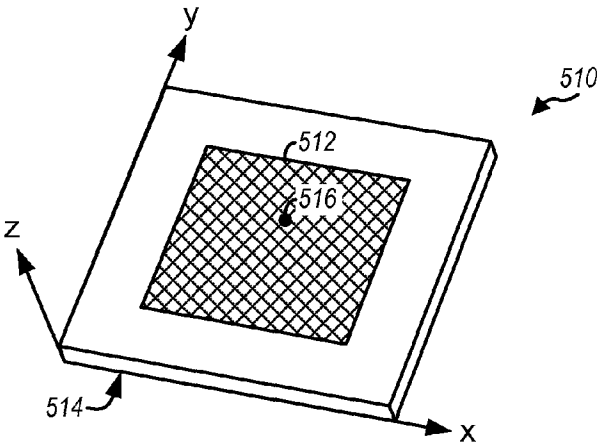
FIGS. 5A, 5B and 5C show an exemplary design of a patch antenna.

FIG. 5A shows an exemplary design of a patch antenna 510 suitable for mm-wave frequency. Patch antenna 510 includes a conductive patch 512 formed over a ground plane 514. Patch 512 has a dimension (e.g., 1.55×1.55 mm) selected based on the desired operating frequency. Ground plane 514 has a dimension (e.g., 2.5×2.5 mm) selected to provide the desired directivity of patch antenna 510. A larger ground plane also results in smaller backlobes. A feedpoint 516 is located near the center of patch 512 and is the point at which an output RF signal is applied to patch antenna 510 for transmission. The location of feedpoint 516 may be selected to provide the desired impedance match to a feedline.

Figure 5B:
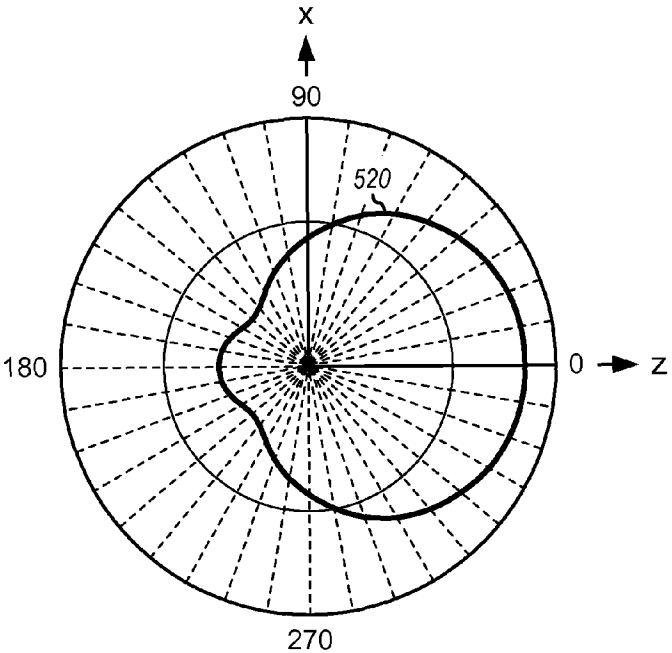

FIG. 5B shows a plot of an antenna beam pattern 520 for patch antenna 510 in FIG. 5A. Antenna beam pattern 520 has a spherical shaped main lobe that points in the z-direction, which is orthogonal to the x-y plane on which patch antenna 510 is formed. The maximum antenna gain is approximately 7 decibel relative to isotropic (dBi) along the z-direction from the center of patch 512.

Figure 5C:
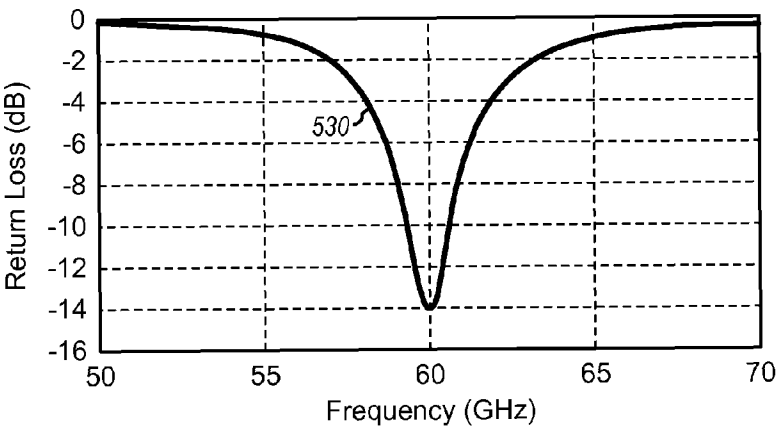

FIG. 5C shows a plot 530 of the frequency response of patch antenna 510 in FIG. 5A. In FIG. 5C, the vertical axis represents return loss in units of decibel (dB), and the horizontal axis represents frequency in units of GHz. As shown in FIG. 5C, patch antenna 510 has a bandwidth of approximately 1.2 GHz centered at approximately 60 GHz. The bandwidth corresponds to a range of frequencies in which the return loss is lower/better than a target return loss, which may be −10 dB in FIG. 5C.

Figure 6B:
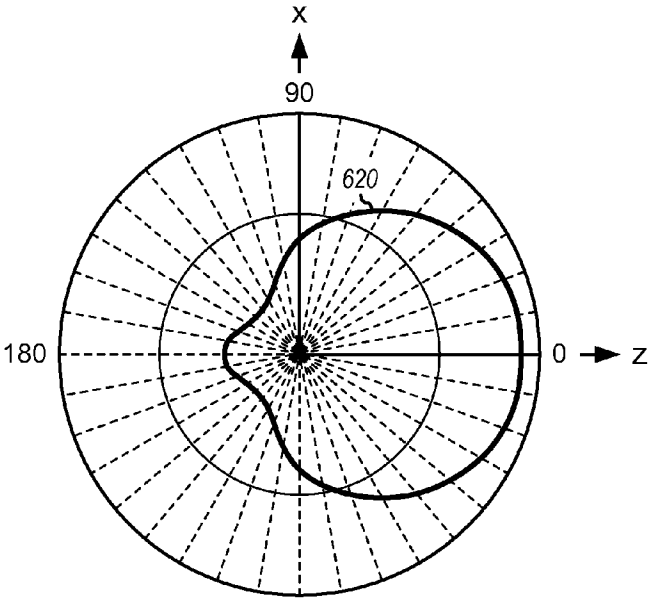
FIGS. 6A, 6B and 6C show another exemplary design of a patch antenna.
Figure 6A:
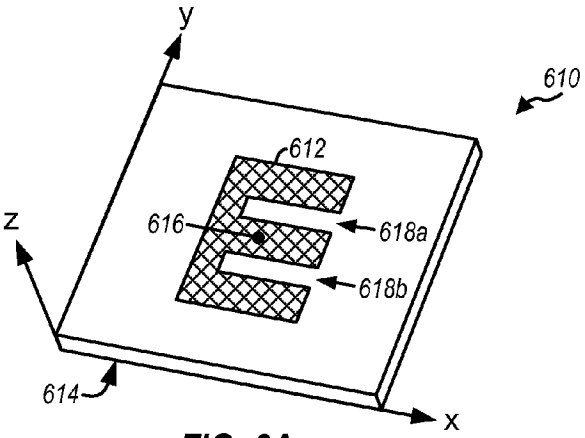

FIG. 6A shows an exemplary design of a patch antenna 610 suitable for mm-wave frequency. Patch antenna 610 includes a conductive E-shaped patch 612 formed over a ground plane 614. Patch 612 has a dimension (e.g., 1.37×2.10 mm) selected based on the desired operating frequency. Each of slots 618*a* and 618*b* has a dimension (e.g., 1.00×0.26 mm) selected based on the desired frequency response. Ground plane 614 has a dimension (e.g., 5.0×5.0 mm) selected to provide the desired directivity. A feedpoint 616 is located near the center of patch 612 and is the point at which an output RF signal is applied to patch antenna 610. The location of feedpoint 616 is selected to provide the desired impedance match.

FIG. 6B shows a plot of an antenna beam pattern 620 for patch antenna 610 in FIG. 6A. Antenna beam pattern 620 has a spherical shaped main lobe that points in the z-direction, which is orthogonal to the x-y plane on which patch antenna 610 is formed. The maximum antenna gain is approximately 8 dBi along the z-direction from the center of patch 612.

Figure 6C:
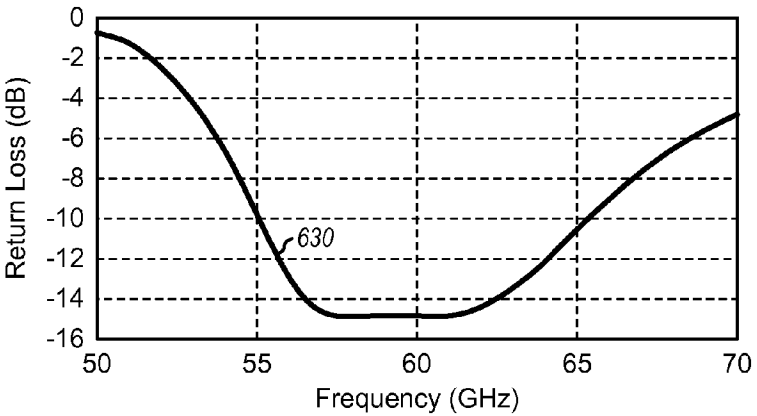

FIG. 6C shows a plot 630 of the frequency response of patch antenna 610 in FIG. 6A. As shown in FIG. 6C, patch antenna 610 has a bandwidth of approximately 10 GHz centered at approximately 60 GHz. This bandwidth is more than adequate for 802.11ad, which operates on 8.64 GHz bandwidth. E-shaped patch antenna 610 in FIG. 6A has a much wider bandwidth than square patch antenna 510 in FIG. 5A.

FIGS. 5A and 6A show two exemplary patch antenna designs. A patch antenna may also be implemented with other shapes such as a rectangular shape, a circular shape, an elliptical shape, an H shape, an O shape, a T shape, a V shape, a W shape, a X shape, a Y shape, a Z shape, etc. Different shapes may be associated with different bandwidths and/or different antenna beam patterns. A suitable patch shape may be selected based on the desired performance, e.g., the desired bandwidth. In general, various characteristics of an antenna such as antenna beam pattern, bandwidth, maximum antenna gain, etc. may be dependent on various factors such as the shape and dimensions of an antenna, the materials used to implement the antenna, etc.

Multiple patch antennas may be arranged in various formations to form an antenna array. Different array formations may be associated with different antenna beam patterns and different maximum antenna gains.

Figure 7A:
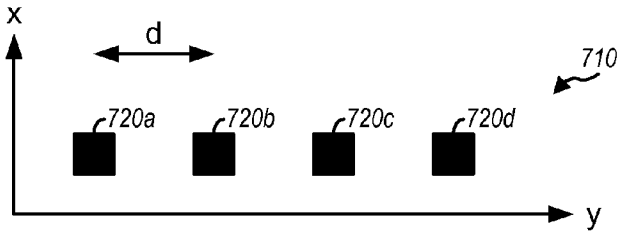
FIGS. 7A, 7B and 7C show an exemplary design of an antenna array.

FIG. 7A shows an exemplary design of a 4×1 antenna array 710 composed of four patch antennas 720*a* to 720*d* arranged in a straight line. Each patch antenna 720 may be implemented with square patch antenna 510 shown in FIG. 5A, E-shape patch antenna 610 shown in FIG. 6A, or a patch antenna of some other shape. Adjacent patch antennas 720 are separated by a distance of d, which may be 2.5, 3, 4, 5, 10, 20 mm, etc. Different antenna beam patterns may be obtained with different separation distances.

Figure 7B:
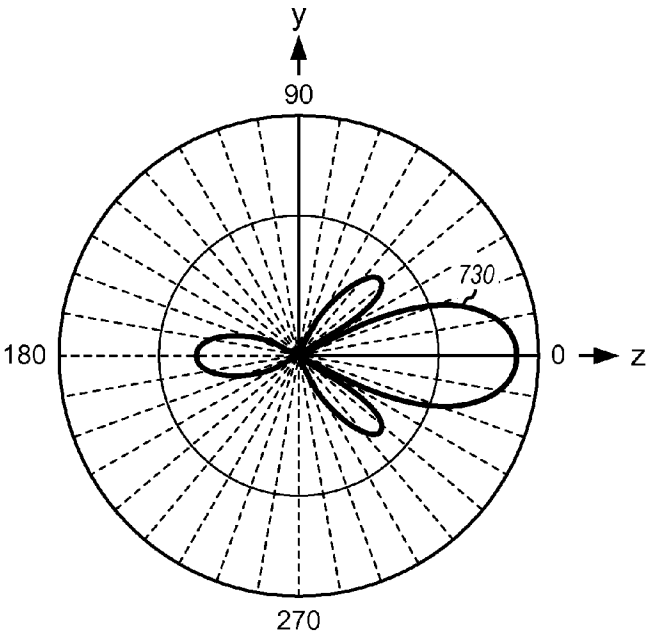

FIG. 7B shows a plot of an antenna beam pattern 730 for patch antenna 710 in FIG. 7A in the y-z plane. Antenna beam pattern 730 has a main lobe that points in the z-direction, which is orthogonal to the x-y plane on which patch antennas 720 are formed.

Figure 7C:
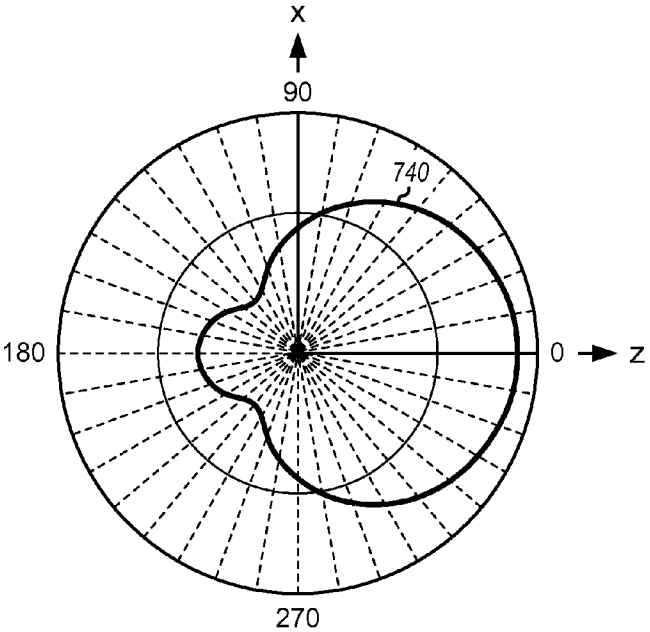

FIG. 7C shows a plot of an antenna beam pattern 740 for patch antenna 710 in FIG. 7A in the x-z plane. Antenna beam pattern 740 has a main lobe that points in the z-direction. The main lobe along the x-axis in FIG. 7C is wider than the main lobe along the y-axis in FIG. 7B.

Figure 8B:
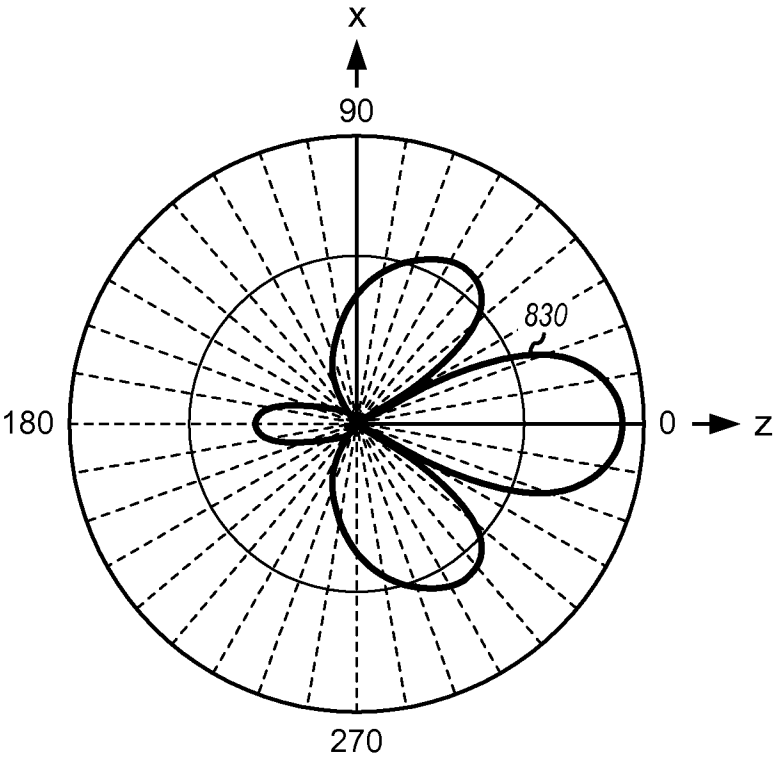
FIGS. 8A and 8B show another exemplary design of an antenna array.
Figure 8A:
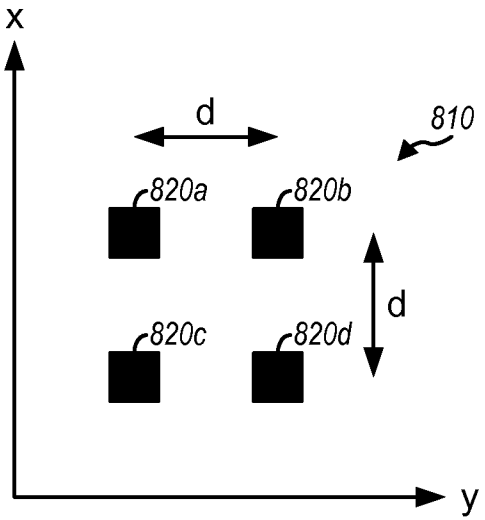

FIG. 8A shows an exemplary design of a 2×2 antenna array 810 composed of four patch antennas 820*a* to 820*d*. Each patch antenna 820 may be implemented with square patch antenna 510, E-shape patch antenna 610, or a patch antenna of some other shape. Patch antennas 820 are separated by a distance of d, which may be 2.5, 3, 4, 5, 10, 20 mm, etc. Different antenna beam patterns may be obtained with different separation distances.

FIG. 8B shows a plot of an antenna beam pattern 830 for patch antenna 810 in FIG. 8A in the x-z plane. Antenna beam pattern 830 has a main lobe that points in the z-direction, which is orthogonal to the x-y plane on which patch antennas 820 are formed. An antenna beam pattern for patch antenna 810 in the y-z plane is similar to antenna beam pattern 830 in the x-z plane.

Figure 9:
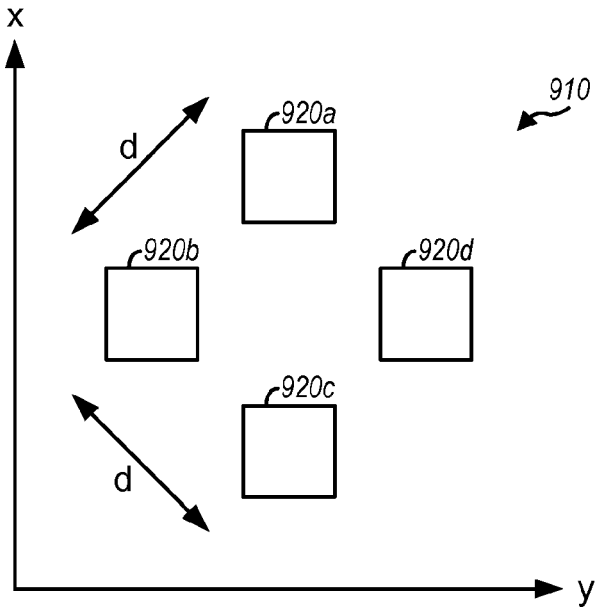
FIG. 9 shows yet another exemplary design of an antenna array.

FIG. 9 shows an exemplary design of an antenna array 910 composed of four patch antennas 920*a* to 920*d*. Each patch antenna 920 may be implemented with square patch antenna 510, E-shape patch antenna 610, or a patch antenna of some other shape. Patch antennas 920 are separated by a distance of d, which may be 2.5, 3, 4, 5, 10, 20 mm, etc.

FIGS. 7A, 8A and 9 show some exemplary antenna arrays. In general, multiple patch antennas may be arranged in any formation, which may be selected based on various factors such as the desired antenna beam pattern, the desired maximum antenna gain, the available space, etc. More patch antennas lined up in a given axis may provide a more focused and narrow antenna beam but a higher antenna gain. Multiple patch antennas lined up in a given axis may also be used for beamforming, as described below.

Figure 10:
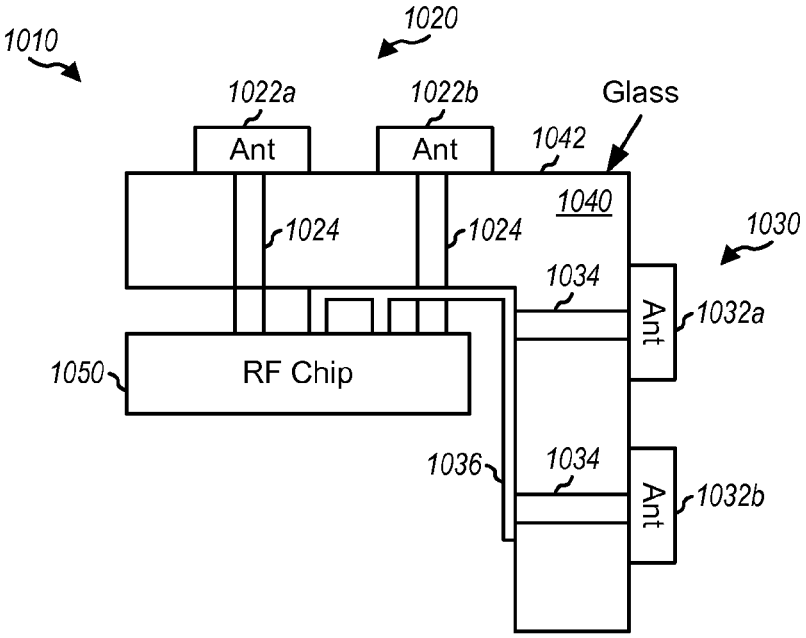
FIG. 10 shows a 3-D antenna system formed on glass.

FIG. 10 shows a side view of an exemplary design of a 3-D antenna system 1010 formed on glass. 3-D antenna system 1010 includes (i) an array 1020 of patch antennas (Ant) 1022*a* and 1022*b* formed on a first plane (e.g., corresponding to the front surface of a wireless device) and (ii) an array 1030 of patch antennas 1032*a* and 1032*b* formed on a second plane (e.g., corresponding to the top surface of the wireless device).

Antennas 1022 and 1032 are formed over an outer surface 1042 of an L-shaped glass substrate 1040. An RF chip 1050 includes (i) transmit circuits to generate output RF signals for transmission via antennas 1022 and 1032 and/or (ii) receive circuits to process received RF signals from antennas 1022 and 1032. RF chip 1050 is electrically coupled to antennas 1022 through vias 1024, which are formed through glass substrate 1040. RF chip 1050 is also electrically coupled to antennas 1032 through a conductive interconnect 1036 and vias 1034, which are formed through glass substrate 1040.

Table 1 lists different ways of forming antennas in a 3-D antenna system. As shown in Table 1, antenna elements may be formed on an integrated circuit (IC) chip, on an IC package, on a circuit board, or on a glass substrate (e.g., as shown in FIG. 10). On-chip implementation may provide easy integration but may have high cost because of the high per unit area cost of an IC chip. On-package implementation may be compact but may require a customized IC package. On-board implementation may provide good performance (depending on the material used for a circuit board) and may provide flexibility. On-glass implementation may have certain advantages such as lower cost, simple integration with microelectromechanical systems (MEMS) technology, and ease of 3-D manufacturing. Antenna elements may be formed on glass based on MEMS or some other process technology. Antennas in a 3-D antenna system may be fabricated based on any one or any combination of the ways listed in Table 1 and/or in other ways. In Table 1, a smaller loss tangent is better and may reduce loss.

TABLE 1

Implementations of Antennas in a 3-D Antenna System

| Antenna | Material | Loss Tangent | Description |
|---|---|---|---|
| On Chip | CMOS wafer | | Easy integration but high cost. |
| On Package | Wafer level package | | Compact implementation; ground plane inside package is not clear; may need a special package design. |
| On Board | FR4 | 0.02 | Low cost but lossy. |
| On Board | Rogers RT/ Duroid 5880 | 0.0009 | Good performance; variety of antenna options available. |
| On Glass | Glass | 0.004 | Can implement antennas with MEMS technology. |

In general, a wireless device may include antenna elements (e.g., patch antennas) formed on any number of planes in a volume, a sphere, or some other shape. Furthermore, any number of antenna elements may be formed on a given plane. The number of planes to use, the number of antenna elements on each plane, and the design of each antenna element may be flexibly selected based on the requirements of the wireless device.

In an exemplary design, beamforming may be used for a 3-D antenna system to improve LOS coverage and/or obtain other advantages. Beamforming may be performed for one or more antenna arrays in the 3-D antenna system. Beamforming may be used to steer an antenna beam of an antenna array in different spatial directions, which would then expand the LOS coverage of the antenna array. Beamforming may be performed for an array of antennas by applying complex gains to multiple signals transmitted via different antennas in the array.

Figure 11:
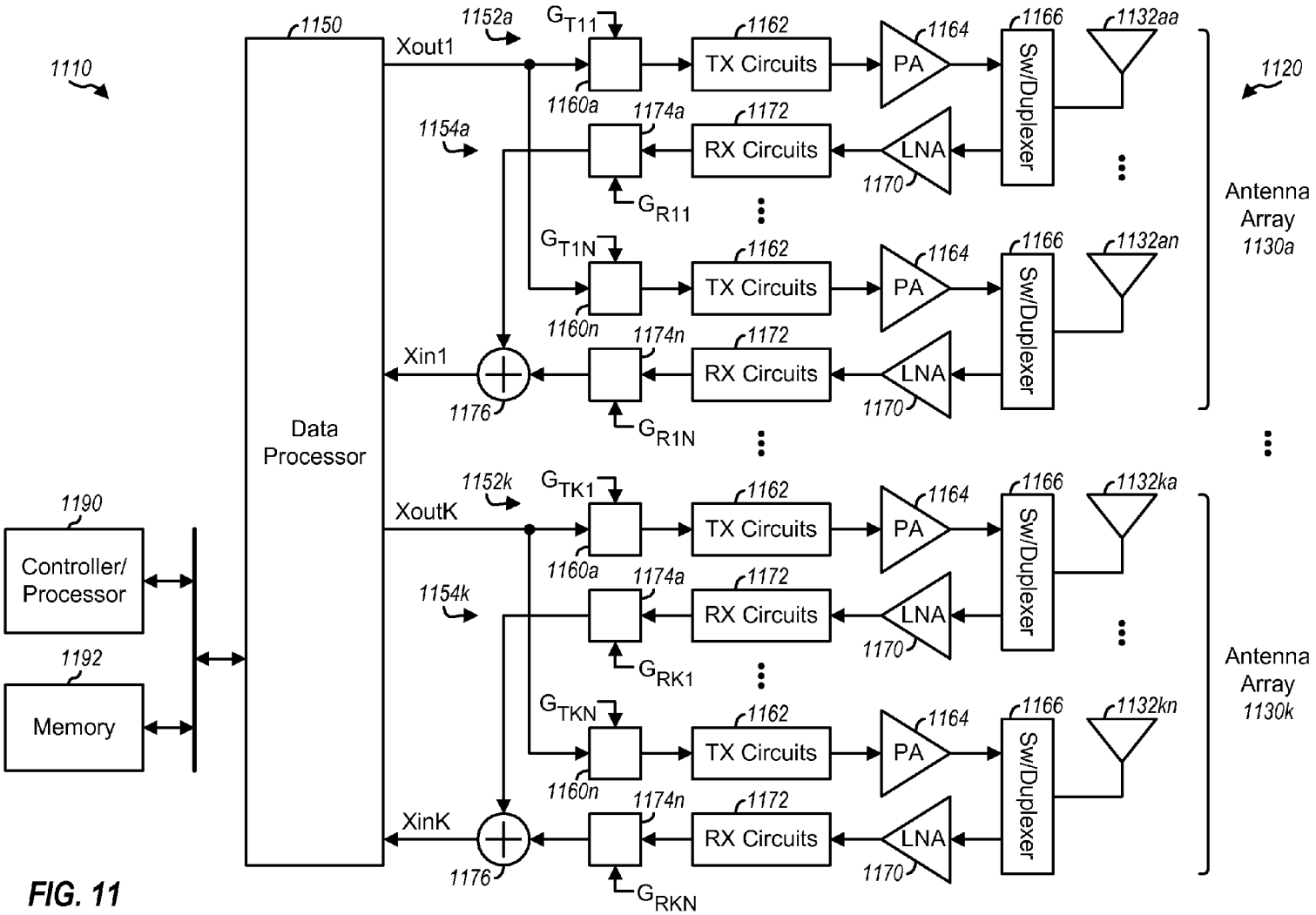
FIG. 11 shows a block diagram of a wireless device with a 3-D antenna system.

FIG. 11 shows a block diagram of an exemplary design of a wireless device 1110 with a 3-D antenna system 1120. In this exemplary design, 3-D antenna system 1120 includes K antenna arrays 1130*a* to 1130*k* formed on K planes pointing in different spatial directions, where K may be any integer value greater than one. Each antenna array 1130 includes N antennas 1132, where N may be any integer value greater than one. The K antenna arrays 1130*a* to 1130*k* may include the same or different numbers of antennas.

For data transmission, a data processor 1150 may process (e.g., encode and modulate) data to be transmitted and provide K data signals Xout1 to XoutK for the K antenna arrays 1130*a* to 1130*k*. In one exemplary design, the K data signals may be identical, and the same information may be sent from all K antenna arrays 1130*a* to 1130*k*. In another exemplary design, the K data signals may be different data signals, and different information may be sent from the K antenna arrays 1130*a* to 1130*k*.

Within a transmit section 1152*a* for antenna array 1130*a*, the Xout1 data signal may be provided to N multipliers 1160*a* to 1160*n*, which may also receive N complex gains $G_{T11}$ to $G_{T1N}$, respectively. Each multiplier 1160 may multiply the Xout1 data signal with its complex gain and provide a scaled data signal. The scaled data signal from each multiplier 1160 may be processed by associated transmit (TX) circuits 1162 and further amplified by an associated power amplifier (PA) 1164 to generate an output RF signal. The output RF signal may be routed through a switchplexer/duplexer (Sw/Duplexer) 1166 and transmitted via an associated antenna 1132. TX circuits 1162 may include digital-to-analog converters (DACs), amplifiers, filters, upconverters/mixers, etc. N scaled data signals from N multipliers 1160*a* to 1160*n* may thus be processed and transmitted via N antennas 1132*aa* to 1132*an* of antenna array 1130*a*. Multipliers 1160*a* to 1160*n* may also be placed at other locations within the N transmit paths (e.g., after TX circuits 1162) in transmit section 1152*a*. Multipliers 1160*a* to 1160*n* may be implemented in hardware, software, firmware, etc.

Each remaining transmit section 1152 may similarly receive and process its data signal with a set of complex gains for its associated antenna array 1130 to generate a set of scaled data signals. The scaled data signals may be further processed and transmitted via N antennas 1132 in the associated antenna array 1130.

For data reception, antenna arrays 1130*a* to 1130*k* may receive RF signals transmitted by other devices. The received RF signals from antennas 1132 may be routed through switchplexers/duplexers 1166, amplified by low noise amplifiers (LNAs) 1170, and further processed by receive (RX) circuits 1172 to obtain received baseband signals. RX circuits 1172 may include downconverters/mixers, amplifiers, filters, analog-to-digital converters (ADCs), etc.

Within a receive section 1154*a* for antenna array 1130*a*, N multipliers 1174*a* to 1174*n* are provided with N received baseband signals from N RX circuits 1172 and also N complex gains $G_{R11}$ to $G_{R1N}$, respectively. Each multiplier 1174 may multiply its received baseband signal with its complex gain and provide a scaled received baseband signal. N received RF signals from N antennas 1132*aa* to 1132*an* of antenna array 1130*a* may thus be processed and scaled by N multipliers 1174*a* to 1174*n*. A summer 1176 may sum the N scaled received baseband signals from multipliers 1174*a* to 1174*n* and provide an input signal Xin1 to data processor 1150. Multipliers 1174*a* to 1174*n* and summer 1176 may also be placed at other locations within the N receive paths (e.g., before RX circuits 1172) in receive section 1154*a*. Multipliers 1174*a* to 1174*n* for each antenna array 1130 may be implemented in hardware, software, firmware, etc. Each remaining receive section 1154 may similarly receive and process its received RF signals with a set of complex gains for its associated antenna array 1130 to generate an input signal. Data processor 1150 may process (e.g., demodulate and decode) the K input signals Xin1 to XinK from K summers 1176 for the K antenna arrays 1130*a* to 1130*k*.

A controller/processor 1190 may direct the operation of various units within wireless device 1110. A memory 1192 may store program codes and data for wireless device 1110. Data processor 1150, controller/processor 1190, and memory 1192 may communicate via a bus 1194 and/or other means.

All or a portion of transmit sections 1152*a* to 1152*k* and receive sections 1154*a* to 1154*k* may be implemented on one or more analog ICs, RF ICs (RFICs), mixed-signal ICs, etc. The remaining portion of transmit sections 1152*a* to 1152*k* and receive sections 1154*a* to 1154*k*, data processor 1150, controller/processor 1190, and memory 1192 may be implemented on one or more application specific integrated circuits (ASICs) and/or other ICs.

Wireless device 1110 may perform beamforming in various manners for 3-D antenna system 1120. Wireless device 1110 may perform beamforming for only one antenna array 1130*a* (e.g., an antenna array on the front surface of wireless device 1110), or all K antenna arrays 1130*a* to 1130*k*, or a subset of the K antenna arrays. In one exemplary design, wireless device 1110 may perform beamforming independently for each antenna array 1130 for which beamforming is supported. For each antenna array 1130, wireless device 1110 may evaluate different antenna beams and may select the antenna beam with the best performance. This may be achieved in various manners.

In one exemplary design, wireless device 1110 may identify the best antenna beam for each antenna array 1130 based on signals received by wireless device 1110. Wireless device 1110 may select one antenna beam at a time for evaluation for a given antenna array. For each antenna beam, wireless device 1110 may detect for signals (e.g., pilot signals and/or data signals) from other devices and may measure the received power of each detected signal. Wireless device 1110 may identify the antenna beam with the highest received power for a device of interest as the best antenna beam for the antenna array. Wireless device 1110 may identify the best antenna beam for each remaining antenna array in similar manner.

In another exemplary design, wireless device 1110 may identify the best antenna beam for each antenna array 1130 based on signals transmitted by wireless device 1110. Wireless device 1110 may select one antenna beam at a time for evaluation for a given antenna array. For each antenna beam, wireless device 1110 may transmit signals (e.g., pilot signals and/or data signals) to other devices. Wireless device 1110 may receive feedback determined by other devices based on the signals transmitted by wireless device 1110. For example, wireless device 1110 may receive feedback indicating the received power of the pilot and/or data signals transmitted by wireless device 1110 as measured at the other devices. As another example, wireless device 1110 may receive feedback indicating whether data signals transmitted by wireless device 1110 have been decoded correctly by the other devices. In any case, wireless device 1110 may identify the antenna beam with the best performance (e.g., the highest received power or the lowest error rate) as the best antenna beam for the antenna array. Wireless device 1110 may identify the best antenna beam for each remaining antenna array in similar manner. In yet another exemplary design, wireless device 1110 may identify the best antenna beam for each antenna array 1130 based on a combination of received signals and transmitted signals.

In general, wireless device 1110 may determine a performance metric for each antenna beam based on one or more criteria. For example, a performance metric may relate to the received power of signals received by wireless device 1110, the received power of signals transmitted by wireless device 1110 as measured at other devices, an error rate of transmitted signals or received signals, etc. Wireless device 1110 may identify the best antenna beam for each antenna array based on the performance metric for each antenna beam for that antenna array.

A set of complex gains or coefficients may be used for each antenna array 1130 to perform beamforming for that antenna array, as shown in FIG. 11. A complex gain may be defined by either (i) a real value A and an imaginary value B (i.e., A+jB) or (ii) an amplitude K and a phase θ (i.e., K ∠θ). In one exemplary design, the complex gains for each antenna array 1130 can have different amplitudes and/or phases, which may be selected to obtain the desired antenna beam. This exemplary design may provide more flexibility to define an antenna beam for an antenna array. In another exemplary design, the complex gains for each antenna array 1130 have the same amplitude (e.g., 1.0) but can have different phases, which may be selected to obtain the desired antenna beam. This exemplary design may allow the full transmit power to be utilized for each antenna 1132. In an exemplary design, one complex gain in a set of complex gains for an antenna array may have a fixed value (e.g., 1.0). This may allow one multiplier (e.g., multiplier 1160*a* in transmit section 1152*a* in FIG. 11) to be omitted.

A plurality of sets of complex gains associated with different antenna beams may be available for an antenna array. In one exemplary design, the plurality of sets of complex gains may be (i) determined a priori based on computer simulations, empirical measurements, and/or via other means and (ii) stored in a non-volatile memory (e.g., memory 1192) on wireless device 1110. For example, M sets of complex gains for M antenna beams pointing in different spatial directions (e.g., evenly spaced apart in the spatial domain) may be determined and stored, where M may be any integer value. One set of complex gains may be applied at any given moment to obtain an antenna beam associated with that set of complex gains.

In another exemplary design, a plurality of sets of complex gains for an antenna array may be adaptively determined. For example, an initial set of complex gains may be used for the antenna array, and a performance metric may be determined for this initial set. One or more complex gains in the initial set may be varied within a predetermined range to obtain a new set of complex gains. The complex gain(s) may be varied randomly or based on a search algorithm. A performance metric may be determined for the new set of complex gains. The new set of complex gains may be retained if the performance metric for the new set is better than the performance metric for the initial set. One or more complex gains may be iteratively varied and evaluated in similar manner until the best performance metric is obtained.

In an exemplary design, an apparatus may comprise first and second sets of antenna elements, e.g., as shown in FIGS. 3 and 11. The apparatus may be a wireless device, an antenna module, an IC chip, an IC package, a circuit board, etc. The first set of antenna elements (e.g., antenna elements 332 in FIG. 3, or antenna elements 1132*aa* to 1132*an* in FIG. 11) may be formed on a first plane of a wireless device and may be associated with a first antenna beam obtained with beamforming, e.g., via a first set of complex gains for the first set of antenna elements. The second set of antenna elements (e.g., antenna elements 342 in FIG. 3, or antenna elements 1132*ka* to 1132*kn* in FIG. 11) may be formed on a second plane of the wireless device. The first and second planes may point in different spatial directions. For example, the first plane may be orthogonal to the second plane of the wireless device.

In an exemplary design, the first plane may correspond to a front surface of the wireless device, and the second plane may correspond to a top surface of the wireless device, e.g., as shown in FIG. 3. The first and second planes may also correspond to other surfaces of the wireless device.

In an exemplary design, the second set of antenna elements may be associated with a second antenna beam obtained with beamforming, e.g., via a second set of complex gains for the second set of antenna elements. In general, beamforming may be performed for only the first set of antenna elements or both the first and second sets of antenna elements. Beamforming may also be performed independently for the first and second sets of antenna elements, e.g., using different sets of complex gains for the two sets of antenna elements. Alternatively, beamforming may be performed jointly for the two sets of antenna elements, e.g., using the same set of complex gains for both sets of antenna elements.

In an exemplary design, the first set of antenna elements may radiate an output signal via the first antenna beam, and the second set of antenna elements may also radiate the output signal via the second antenna beam. In this exemplary design, the same output signal may be transmitted from both sets of antenna elements. In another exemplary design, different output signals may be transmitted from the first and second sets of antenna elements.

In an exemplary design, the same antenna beam may be used for both transmission and reception. In this exemplary design, the first set of antenna elements may receive a signal from another device via the first antenna beam. In another exemplary design, different antenna beams may be used for transmission and reception. In this exemplary design, the first set of antenna elements may receive a signal from another device via another antenna beam obtained with beamforming, e.g., via another set of complex gains for the first set of antenna elements, e.g., as shown in FIG. 11.

The apparatus may further comprise first and second sets of power amplifiers, e.g., as shown in FIG. 11. The first set of power amplifiers (e.g., power amplifiers 1164 in transmit section 1152*a* in FIG. 11) may receive a first set of input signals generated based on the output signal and may provide a first set of output RF signals for transmission via the first set of antenna elements. The second set of power amplifiers (e.g., power amplifiers 1164 in transmit section 1152*k* in FIG. 11) may receive a second set of input signals generated based on the same output signal or another output signal and may provide a second set of output RF signals for transmission via the second set of antenna elements.

The apparatus may further comprise first and second sets of LNAs, e.g., as shown in FIG. 11. The first set of LNAs (e.g., LNAs 1170 in receive section 1154*a* in FIG. 11) may receive a first set of received RF signals from the first set of antenna elements and may provide a first set of amplified signals. The second set of LNAs (e.g., LNAs 1170 in receive section 1154*k* in FIG. 11) may receive a second set of received RF signals from the second set of antenna elements and may provide a second set of amplified signals.

In an exemplary design, the first set of antenna elements may form a first antenna array, and the second set of antenna elements may form a second antenna array. In an exemplary design, the first set of antenna elements may comprise a plurality of patch antennas, which may be arranged in a 2-D array. In an exemplary design, each patch antenna may have a square shape, as shown in FIG. 5A. In another exemplary design, each patch antenna may have a non-square shape, i.e., any shape that is not a square or a rectangle. For example, each patch antenna may have an E shape, as shown in FIG. 6A.

In an exemplary design, the first set of antenna elements may be formed on a first surface of a glass substrate, and the second set of antenna elements may be formed on a second surface of the glass substrate, e.g., as shown in FIG. 10. The second surface may be orthogonal to the first surface. In other exemplary designs, the first and second sets of antenna elements may be formed on an IC chip, an IC package, a circuit board, etc., as listed in Table 1.

In an exemplary design, the apparatus may further comprise a memory that stores a plurality of sets of complex gains associated with different antenna beams for the first set of antenna elements. The first set of complex gains for the first set of antenna elements may be one of the plurality of sets of complex gains. In an exemplary design, the complex gains in the first set may have equal amplitude and variable phases (i.e., possibly different phases). In another exemplary design, the complex gains in the first set may have variable amplitudes and variable phases (i.e., possibly different amplitudes and phases).

In an exemplary design, the first and second sets of antenna elements may operate at a millimeter wave frequency between 40 and 300 GHz. The first and second sets of antenna elements may also operate at other frequency ranges.

The apparatus may also include one or more additional sets of antenna elements formed on one or more additional planes of the wireless device. Each set of antenna elements may be associated with a respective antenna beam pointing in a different spatial direction. The first, second, and possibly additional sets of antenna elements may provide better LOS coverage and possibly better NLOS coverage for the wireless device.

Figure 12:
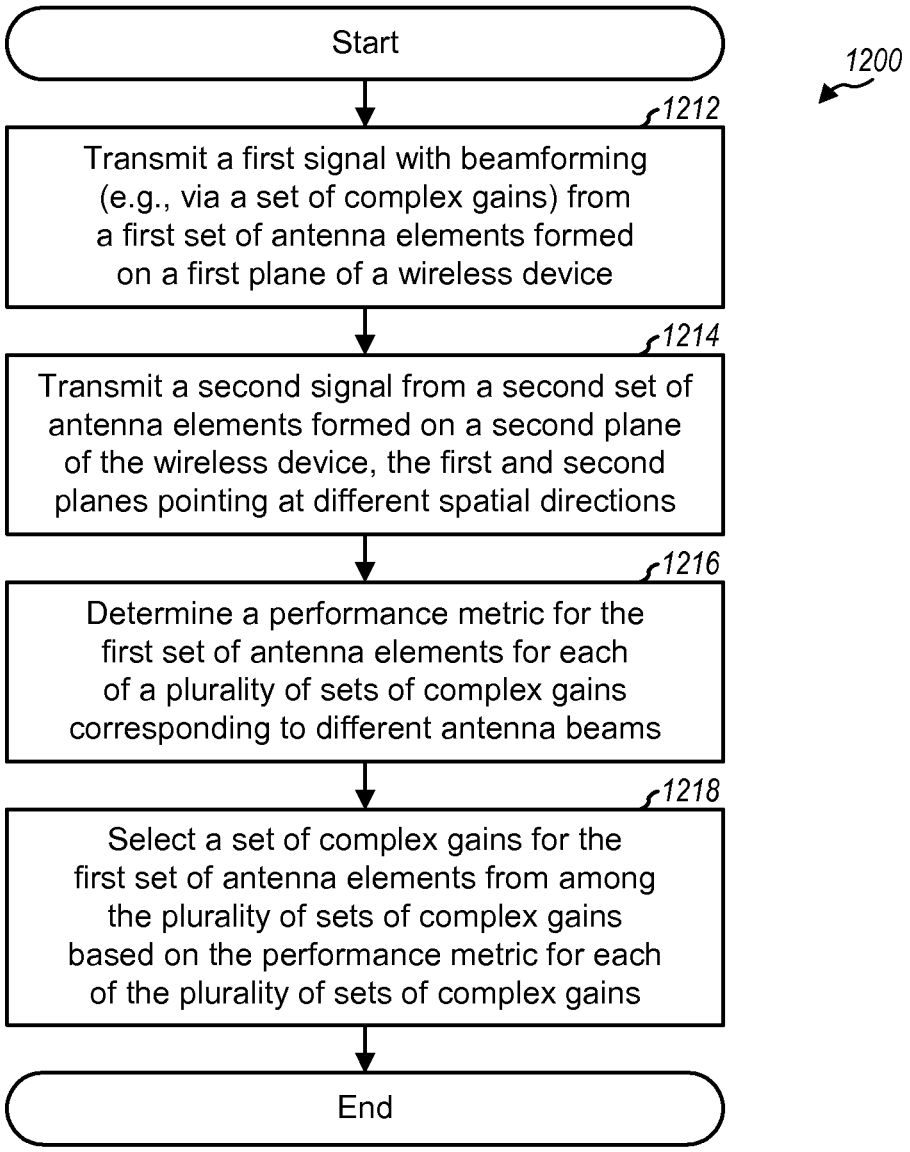
FIG. 12 shows a process for transmitting signals with a 3-D antenna system.

FIG. 12 shows an exemplary design of a process 1200 for transmitting signals with a 3-D antenna system. A first signal may be transmitted with beamforming from a first set of antenna elements formed on a first plane of a wireless device (block 1212). The first signal may be transmitted with beamforming via a first set of complex gains for the first set of antenna elements. A second signal may be transmitted from a second set of antenna elements formed on a second plane of the wireless device (block 1214). The second signal may also be transmitted with beamforming, e.g., via a second set of complex gains for the second set of antenna elements. The first and second planes may point in different spatial directions.

In an exemplary design, the first and second signals may comprise the same output signal. This exemplary design may improve LOS coverage of the wireless device. In another exemplary design, the first and second signals may comprise different output signals. This exemplary design may enable the wireless device to transmit to multiple other devices simultaneously, e.g., as shown in FIG. 3.

In an exemplary design, a performance metric may be determined for the first set of antenna elements for each of a plurality of sets of complex gains corresponding to different antenna beams (block 1216). A set of complex gains may be selected from among the plurality of sets of complex gains based on the performance metric for each of the plurality of sets of complex gains (block 1218). The selected set of complex gains may be used for beamforming for the first set of antenna elements. Blocks 1216 and 1218 may be performed after blocks 1212 and 1214 (as shown in FIG. 12) or before blocks 1212 and 1214 (not shown in FIG. 12).

In an exemplary design, a third signal may be received via the first set of antenna elements. The third signal may be received with beamforming, e.g., via the first set of complex gains or a third set of complex gains for the first set of antenna elements. A fourth signal may be received via the second set of antenna elements. The fourth signal may be received with beamforming, e.g., via the second set of complex gains or a fourth set of complex gains for the first set of antenna elements. For each set of antenna elements, the same antenna beam may be used for both transmission and reception, or different antenna beams may be used for transmission and reception.

Certain parts of a wireless device with a 3-D antenna system described herein may be implemented on an IC, an analog IC, an RFIC, a mixed-signal IC, an ASIC, a printed circuit board (PCB), an electronic device, etc. Circuitry supporting transmission and/or reception of signals via the 3-D antenna system may be fabricated with various IC process technologies such as complementary metal oxide semiconductor (CMOS), N-channel MOS (NMOS), P-channel MOS (PMOS), bipolar junction transistor (BJT), bipolar-CMOS (BiCMOS), silicon germanium (SiGe), gallium arsenide (GaAs), heterojunction bipolar transistors (HBTs), high electron mobility transistors (HEMTs), silicon-on-insulator (SOI), etc.

An apparatus with a 3-D antenna system described herein may be a stand-alone device or may be part of a larger device. A device may be (i) a stand-alone IC, (ii) a set of one or more ICs that may include memory ICs for storing data and/or instructions, (iii) an RFIC such as an RF receiver (RFR) or an RF transmitter/receiver (RTR), (iv) an ASIC such as a mobile station modem (MSM), (v) a module that may be embedded within other devices, (vi) a receiver, cellular phone, wireless device, handset, or mobile unit, (vii) etc.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. An apparatus comprising:

a first set of antenna elements formed on a first plane of a wireless device and associated with a first antenna beam obtained with steerable beamforming; and a second set of antenna elements formed on a second plane of the wireless device and associated with a second antenna beam obtained with steerable beamforming, the first and second planes being orthogonal to each other and a first signal radiating from the first plane and a second signal radiating from the second plane having different phases.

2. The apparatus of claim 1, wherein the beamforming is via a first set of complex gains for the first set of antenna elements.

3. The apparatus of claim 2, wherein the beamforming is via a second set of complex gains for the second set of antenna elements.

4. The apparatus of claim 1, wherein the first set of antenna elements radiates an output signal via the first antenna beam, and wherein the second set of antenna elements radiates the output signal via a second antenna beam.

5. The apparatus of claim 1, wherein the first set of antenna elements receives a signal from another device via the first antenna beam.

6. The apparatus of claim 1, further comprising:

a first set of power amplifiers configured to receive a first set of input signals generated based on a first output signal and to provide a first set of output radio frequency (RF) signals for transmission via the first set of antenna elements; and a second set of power amplifiers configured to receive a second set of input signals generated based on the first output signal or a second output signal and to provide a second set of output RF signals for transmission via the second set of antenna elements.

7. The apparatus of claim 1, further comprising:

a first set of low noise amplifiers (LNAs) configured to receive a first set of received radio frequency (RF) signals from the first set of antenna elements and to provide a first set of amplified signals; and a second set of LNAs configured to receive a second set of received RF signals from the second set of antenna elements and to provide a second set of amplified signals.

8. The apparatus of claim 1, wherein the first plane is orthogonal to the second plane.

9. The apparatus of claim 1, wherein the first set of antenna elements comprises a plurality of patch antennas.

10. The apparatus of claim 9, wherein each of the plurality of patch antennas has a non-square shape or an E-shape.

11. The apparatus of claim 1, wherein the first set of antenna elements is formed on a first surface of a glass substrate, and wherein the second set of antenna elements is formed on a second surface of the glass substrate.

12. The apparatus of claim 2, further comprising:

a memory configured to store a plurality of sets of complex gains associated with different antenna beams for the first set of antenna elements, the first set of complex gains being one of the plurality of sets of complex gains.

13. The apparatus of claim 2, wherein the complex gains in the first set have equal amplitude and variable phases.

14. The apparatus of claim 1, wherein the first and second sets of antenna elements operate at a millimeter wave frequency between 40 and 300 gigahertz (GHz).

15. A method comprising:

transmitting a first signal with steerable beamforming from a first set of antenna elements formed on a first plane of a wireless device; and transmitting a second signal with steerable beamforming from a second set of antenna elements formed on a second plane of the wireless device, the first and second planes being orthogonal to each other and a first signal radiating from the first plane and a second signal radiating from the second plane having different phases.

16. The method of claim 15, wherein the first signal is transmitted with beamforming via a first set of complex gains for the first set of antenna elements, and wherein the second signal is transmitted with beamforming via a second set of complex gains for the second set of antenna elements.

17. The method of claim 15, further comprising:

determining a performance metric for the first set of antenna elements for each of a plurality of sets of complex gains corresponding to different antenna beams; and selecting a set of complex gains from among the plurality of sets of complex gains based on the performance metric for each of the plurality of sets of complex gains, wherein the first signal is transmitted with beamforming via the selected set of complex gains.

18. The method of claim 15, further comprising:

receiving a third signal with beamforming via the first set of antenna elements.

19. An apparatus comprising:

means for transmitting a first signal with steerable beamforming from a first set of antenna elements formed on a first plane of a wireless device; and means for transmitting a second signal with steerable beamforming from a second set of antenna elements formed on a second plane of the wireless device, the first and second planes being orthogonal to each other and a first signal radiating from the first plane and a second signal radiating from the second plane having different phases.

20. The apparatus of claim 19, further comprising:

means for determining a performance metric for the first set of antenna elements for each of a plurality of sets of complex gains corresponding to different antenna beams; and means for selecting a set of complex gains from among the plurality of sets of complex gains based on the performance metric for each of the plurality of sets of complex gains, wherein the first signal is transmitted with beamforming via the selected set of complex gains.

* * * * *